United States Patent [19]

Schmidt

[11] 4,412,623

[45] Nov. 1, 1983

[54] TEAT FEEDING BOTTLE HAVING A PIERCEABLE WALL AND SPIKE OPENING MEANS

[76] Inventor: Manfred Schmidt, Butzbacher Pfad 14, D-6365 Rosbach, Fed. Rep. of Germany

[21] Appl. No.: 334,551

[22] Filed: Dec. 28, 1981

[30] Foreign Application Priority Data

Feb. 11, 1981 [DE] Fed. Rep. of Germany ..... 3104861

[51] Int. Cl.[3] ..... A61J 9/00; A61J 11/00; A61J 15/00

[52] U.S. Cl. ..... 215/11 R; 215/11 C; 215/247

[58] Field of Search ..... 215/11 R, 11 A, 11 B, 215/11 C, 11 D, 11 E, 247

[56] References Cited

U.S. PATENT DOCUMENTS

| | | | |
|---|---|---|---|
| 3,146,904 | 9/1964 | Hansen et al. | 215/11 R |
| 3,266,910 | 8/1966 | Barnby | 215/11 R |
| 3,334,764 | 8/1967 | Fouser | 215/11 R |
| 3,393,817 | 7/1968 | Meierhoefer | 215/11 C |
| 3,439,824 | 4/1969 | Merrill, Jr. et al. | 215/11 C |
| 3,519,157 | 7/1970 | Meierhoefer | 215/11 C |
| 3,635,724 | 1/1972 | Schaar | 215/11 C |

*Primary Examiner*—William Price
*Assistant Examiner*—Sue A. Weaver
*Attorney, Agent, or Firm*—Cushman, Darby & Cushman

[57] ABSTRACT

A teat feeding bottle comprises a container (1) having a neck portion (11) which includes external threads (12) and a pierceable wall (13). A screw cap (5) is provided with internal threads (53) and a flange (52) which sealingly clamps a flange (42) of the teat. A spike (3) accommodated completely within said teat and having a pointed tip (31) on its one end and a pushbutton-like enlargement (32) on its other end, is guided within an opening (22) of a longitudinal guiding portion (2). The longitudinal guiding portion (2) extends partially into the interior of the teat (4) and has a flange (21) thereof fixed by the screw cap (5). The spike (3) has a longitudinally (axially) extending groove (33) which, in combination with the wall of opening (22) opposing this groove, defines a passage for liquid dispensed from the container (1) when the spike has penetrated the pierceable wall (13). Upon penetration of this wall, the spike remains within the interior of the teat or of the container (1), respectively.

9 Claims, 10 Drawing Figures

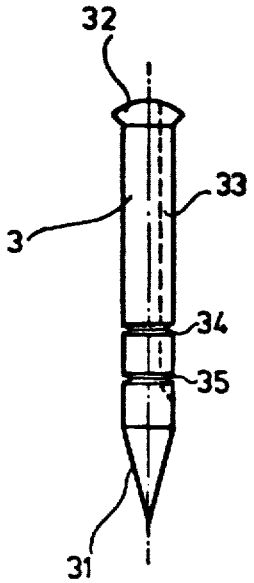
FIG. 3A
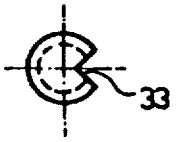
FIG. 3B
FIG. 5
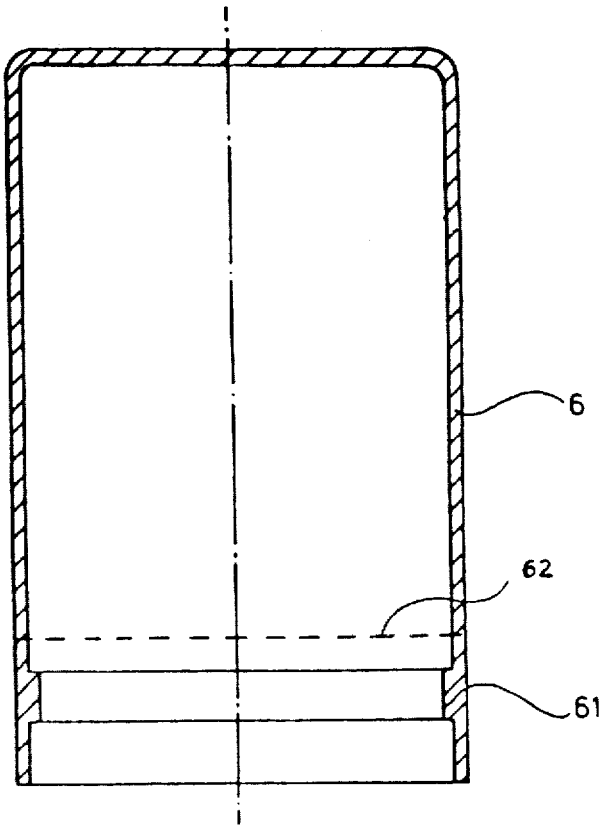
FIG. 4
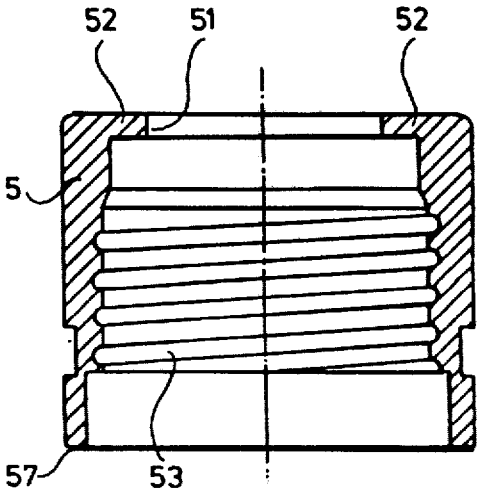

SECTION
A-B

TEAT FEEDING BOTTLE HAVING A PIERCEABLE WALL AND SPIKE OPENING MEANS

The present invention relates to a teat feeding bottle comprising a container, a screw cap, a teat and a spike, with a peripherally extending flange of said teat being sealingly clamped by the flange of said screw cap against a neck portion of said container, while said teat freely extends outwards from said screw cap, and with said spike, while extending up to the top of said teat, being positioned substantially vertically and spaced with its (pointed) tip from a pierceable wall of said container.

A teat feeding bottle of this type is known from U.S. Pat. No. 3,519,157. The container receiving the liquid infant food is closed hermetically and in sterile fashion by a pierceable wall. For opening the container, the pointed end of the spike is driven through the pierceable wall by applying pressure to the top of the teat. Upon releasing the top of the teat, the spike is retracted from the pierceable wall under the resilient force of the teat. This operation is repeated until the total aperture cross-section of the thus formed perforations in the pierceable wall is sufficient. Then, the spike the upper end of which extends to a point outside the top of the teat, is removed manually.

This prior teat feeding bottle suffers from the following drawbacks: The pierceable wall must be relatively thin in order to allow the spike to be pulled out easily. The spike must have approximately the same diameter as the hole in the teat. Therefore, the pierceable wall must be pierced repeatedly in a number of positions in order to provide for proper feed supply. To this end, the longitudinal axis of the spike must be inclined in various directions. Opening of the feeding bottle is therefore a relatively time-consuming and complicated operation. Due to the final manual removal of the spike, bacteria of germs may settle on the outer side of the teat top.

In view of the fact that the perforations formed by the spike in the pierceable wall are relatively small diameter, the teat feeding bottle can contain relatively thinly liquid foods only, but not thickened foods, such as paps, etc.

A similar teat feeding bottle is known from U.S. Pat. No. 3,266,910, which bottle includes, in the place of a needle-like spike, a disc-shaped opening portion having a short pointed projection which extends towards the pierceable wall and which has a central passage extending therethrough. By applying mechanical pressure to the edge of this disc-shaped portion, the pierceable wall is perforated, with the pointed projection having barb-like serrations on its outer circumference, which serrations then retain the opening part within the perforated wall.

Finally, U.S. Pat. No. 3,146,904 shows a teat feeding bottle wherein a pointed element integrally connected to the screw cap ruptures the pierceable wall when the screw cap is screwed down.

The present invention contemplates to improve the teat feeding bottle of the type as described above in such a manner that the discussed drawbacks are avoided.

Accordingly, it is the object of the present invention to improve the teat feeding bottle of the type as outlined above, such that this bottle may be opened more easily. Of course, it should hereby be possible to open the bottle while positively preserving sterile conditions therein, and the invention contemplates to provide for a possible opening of a plurality of feeding bottles at the same time by one person.

This object is solved by a longitudinal guiding portion for the pointed end of said spike, said guiding portion being clamped between said pierceable wall and said flange of said screw cap; and a pushbutton-like enlargement of said spike positioned within the interior of said teat and provided on the opposite end of said spike.

In this construction, the spike does not pass through the top of the teat, but is positioned completely within the teat.

In an advantageous embodiment of the invention, the longitudinal guiding portion includes a central opening the inner diameter of which is slightly larger than the outer diameter of the spike, with the spike being provided with a longitudinal (axial) groove. In this way, the spike is exactly guided, whereby the liquid may flow via the longitudinal groove and its confines through the inner diameter of the central opening.

In order that the spike is positively kept in its lowermost position upon piercing the wall, the part of the spike adjacent to its pointed tip is provided with at least one radially cut, annular notch which retains the spike on the perforated wall.

In order to provide for proper mounting of the longitudinal guiding portion, the latter includes a radially projecting annular flange disposed between the flange of the teat and a sealing ring, with a cylindrical and/or conical part extending from this annular flange in the direction of the interior of the teat.

In order to provide for sterile sealing and further facilitated opening of the teat feeding bottle, the screw cap has in its outer peripheral surface a radially cut annular groove which is engaged with an annular projection of a cylindrical closure or sealing cap. For opening of the feeding bottle, pressure is applied to the upper end of this closure cap such that, as a result, the respective surface of the closure cap exerts a pressure on the upper end of the spike, whereby the annular projection of the closure cap then becomes disengaged from the radially cut annular groove of the screw cap.

For facilitating this operation, the screw cap is provided with a conical enlargement or bulge which diverges from the groove towards the container and which acts to expand the closure cap.

Finally, such expansion is further promoted by the fact that the closure cap includes longitudinally extending breaking (rupturing) notches in its end facing the container.

Below, preferred embodiments of the invention are explained in greater detail by referring to the accompanying drawings, wherein:

FIGS. 3A and 3B are a side elevational view and a plan view, respectively, of a spike for use in the feeding bottle of FIG. 1;

FIG. 4 is a sectional view of a screw cap for use in the feeding bottle of FIG. 1;

FIG. 5 is a sectional view of a closure or sealing cap for use in the feeding bottle of FIG. 1;

In the embodiments, identical parts are identified by identical reference numerals.

Figure 1:
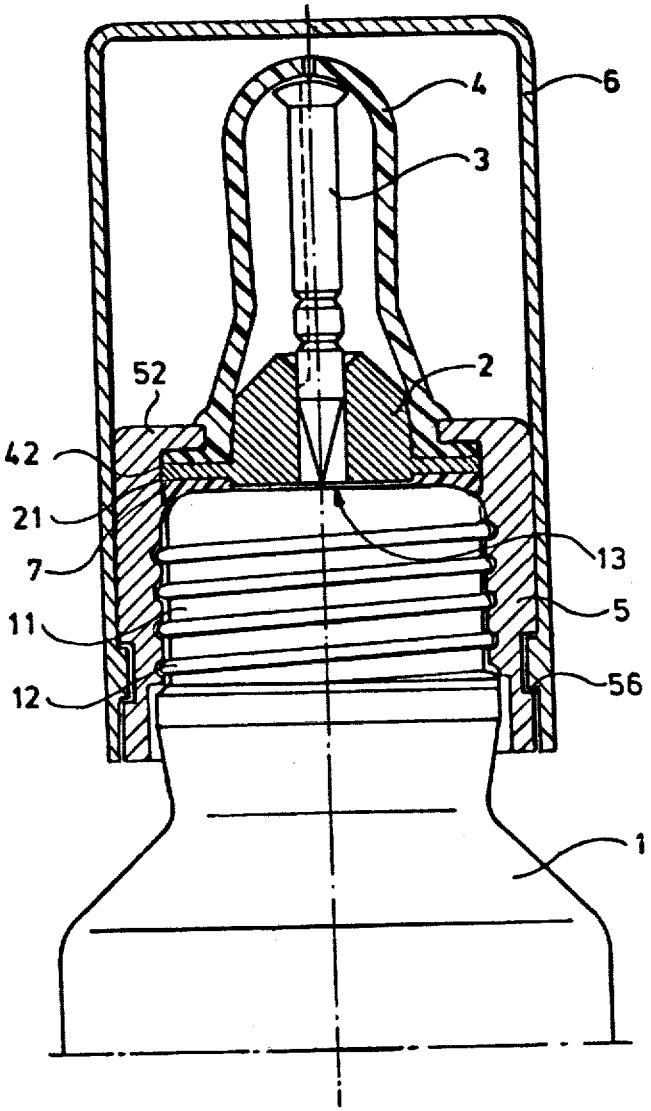
FIG. 1 is a sectional view of the assembled upper portion of the teat feeding bottle according to a first embodiment of the invention.

FIG. 1 shows a bottle-like container 1 the upper end of which joins a neck portion 11 provided with external threads 12. The upper end of the neck portion is sealed by a pierceable wall 13. The neck portion 11 including the threads 12 and the pierceable wall 13 is formed integrally and unitarily with the remainder of the container 1.

Figure 2:
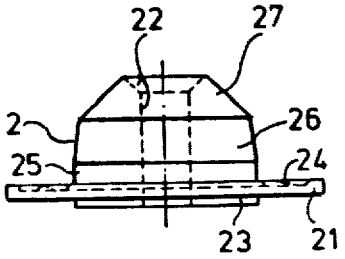
FIG. 2 is a side elevational view of a guiding portion which is used in the feeding bottle according to FIG. 1.

A screw cap 5 (FIG. 4) having internal threads 53 is threadingly engaged with the external threads 12. The upper end of the screw cap 5 is provided with an opening 51 the diameter of which is smaller than the diameter of the threads 53 such that an annular flange 52 is formed at the upper end of the screw cap 5. In this structure, the opening 51 is matched in its diameter to the outer diameter of the lower end of a teat 4. The lower end of the teat 4 has a radially projecting annular flange 42 which extends to the inner wall of the screw cap 5. A longitudinal guiding portion 2 (see FIG. 2) includes a radially projecting, peripherally extending or annular flange 21 the outer diameter of which is equal to the inner diameter of the screw cap 5. Extending upwards in the direction of the inner cavity of the teat 4 are a first cylindrical part 25 and a pair of adjoining conical parts 26 and 27 with different angles of inclination of their circumferential surfaces. The upper conical part 27 is of frustoconical configuration. Extending downwards from flange 21 is a short cylindrical projection or boss 23 the diameter of which is slightly larger than the diameter of cylindrical part 25. The diameter of cylindrical part 25 is equal to the inner diameter of the lower portion of teat 4 in this structure.

Extending centrally through the longitudinal guiding portion 2 is a longitudinal opening 22 of circular cross-section. This opening 22 serves as a guide for a spike 3. The upper side of the flange 21 is further provided with a peripherally extending recess 24 the sidewalls of which are each spaced from cylindrical part 25 and from the outer edge of flange 21. This recess 24 which contacts the lower side of the flange 42 of teat 4, is provided for improved sealing. Alternatively, however, this recess may be omitted, as shown in FIG. 1.

Disposed between the pierceable wall 13 and the underside of flange 21 of the longitudinal guiding portion 2 is a sealing ring or washer 7 (FIG. 1) the inner edge of which contacts the boss 23 of guiding portion 2 so as to be centered thereby. Fitted into the teat 4 is a spike 3 (see FIGS. 3A and 3B) the pointed lower end of which is guided in the opening 22 of the longitudinal guiding portion 2. In this embodiment, the outer diameter of spike 3 is only slightly smaller than the inner diameter of opening 22. The pointed lower end 31 of spike 3 extends to the outer side of the pierceable wall 13, while its upper end, having formed thereon a pushbutton-like enlargement 32, extends to a position almost reaching the inner wall of the top of teat 4.

The spike is provided with a longitudinal (axial) lateral groove 33 which extends from the pushbutton-like enlargement 32 to a position closely adjacent the section including the tip 31. In the embodiment shown, this groove 33 has a V-shaped cross-section.

Still further, the spike 3 is formed with a plurality of radially cut (V) notches 34 and 35 (three notches are shown in FIG. 1), which notches are so positioned in longitudinal or axial direction of the spike that they, with the spike 3 urged downwards, are positioned at the level of the pierceable wall 13. Thus, these notches are formed, for example, in the lower half of spike 3.

Finally, the assembly includes a cylindrical closure or sealing cap 6 (see FIG. 5) which has adjacent its lower end an annular, radially inwardly projection collar 61. The upper end of this closure cap is closed. Collar 61 is adapted to engage into a groove 56 provided in the outer surface of screw cap 5 (see FIG. 1) or behind the lower edge 57 of the screw cap (see FIG. 4).

(In order to urge the spike 3 through the pierceable wall 13 by manipulation of the closure cap (protective cap), the annular, radially inwardly projecting collar 61 must be removed from the closure cap. This removal is facilitated by a perforation or weakened part extending in parallel with the collar 61 and including a punched-out gripping end; such perforation or the like is also used as an indicator of intactness).

As appears from FIG. 1, the teat feeding bottle is assembled as follows. The sealing ring or washer 7 is positioned relative to the guiding portion 2. Then, the spike 3 is placed into opening 22, whereupon the teat 4 is slid over the conical part of the longitudinal guiding portion 2. Thereafter, the screw cap 5 is slid over the teat 4 until the flange 42 of the teat engages the flange 52. In this position, the sealing ring or washer 7 retains the longitudinal guiding portion 2 relative to the screw cap 5. Following this step, the screw cap 5 is threadingly engaged with the neck portion 11.

For opening the teat feeding bottle, pressure is applied from above to the closure cap 6—if applicable, after removing a tear-off ring from the closure cap 6. In this way, pressure is exerted on the pushbutton-like enlargement 32 of the spike 3 via the top of the teat. The spike guided within the opening 22 of the longitudinal guiding portion 2 penetrates with its tip 31 the pierceable wall 13. The spike 3 is hereby pressed down to such extent that the groove 33 comes to lie on opposite sides of the perforated wall 13, and one of the (V) notches 34, 35 becomes locked by the perforated wall 13. Then, the liquid from the container passes through the perforated hole and the groove 33 into the interior of the teat 4 and then to the exterior via the teat hole 41. Of course, the closure cap 6 must be removed first, and the container 1 must be tilted, before the liquid can flow out.

It is evident that opening of the teat feeding bottle may be effected by simply exerting mechanical pressure on the upper part of the closure cap 6. Owing to the pushbutton-like enlargement 32, the pressure is transmitted to the spike 3 across the large surface area, thereby also avoiding damage to the top of the teat 4. The longitudinal guiding portion 2 for the spike 3 prevents the latter from yielding in lateral direction, whereby it is ensured that the tip 31 penetrates the pierceable wall 13 in a predetermined position. Also, the material may be weakened in this position for providing a breaking (rupturing) point. The spike 3 is left within the sterile interior between the teat and the container and need not be removed. Accordingly, its diameter may be substantially greater than that of the teat hole 41, such that considerably greater perforations may be formed in the pierceable wall 13. In this construction, the groove 33 may be of such dimensions that even more viscous foodstuffs may flow therethrough.

Also, it is evident that a plurality of teat feeding bottles may be opened simultaneously by only one person. When a plurality of feeding bottles are placed side by side on a solid support, these bottles may be subjected to a pressure with the aid of an object, e.g. a plate or board, such that these bottles are opened simultaneously.

Figure 6:
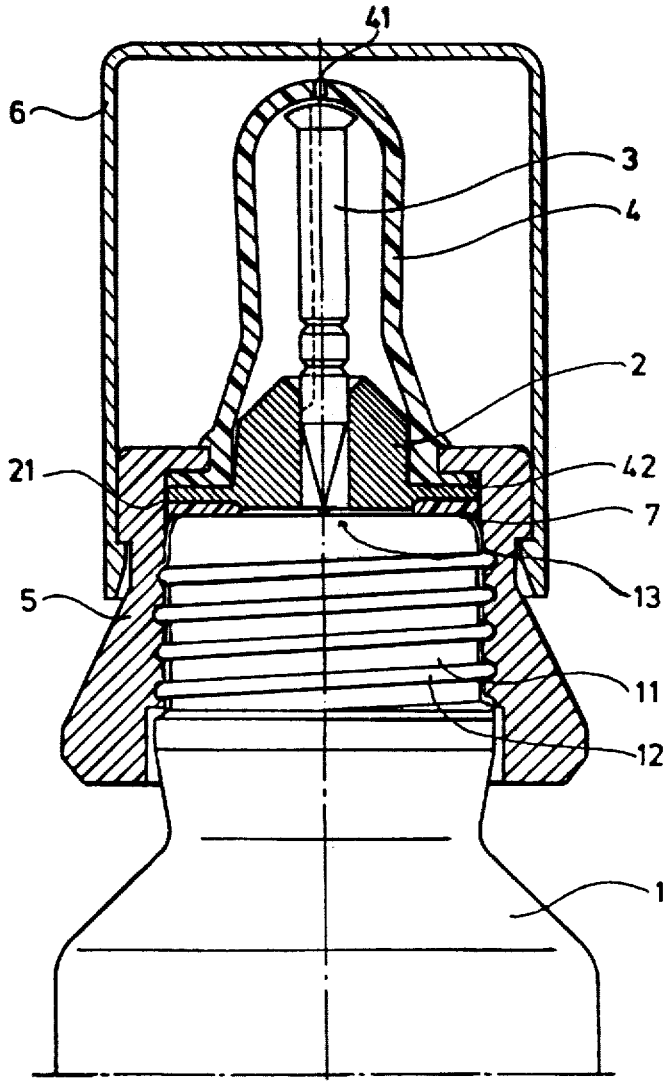
FIG. 6 is a sectional view similar to FIG. 1, but showing a second embodiment of the invention.
Figure 6A:
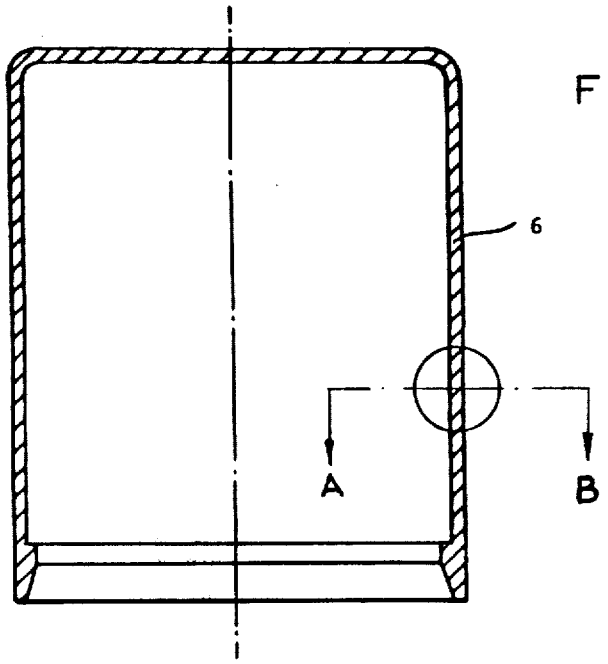
FIGS. 6A and 6B are a longitudinal sectional view of a closure cap and a part cross-sectional view thereof, respectively, for illustrating breaking (rupturing) formations.
Figure 6B:
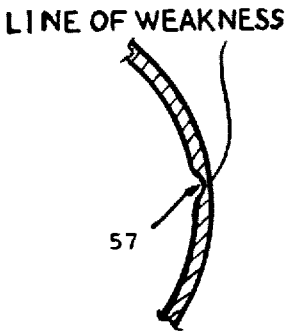
Figure 7:
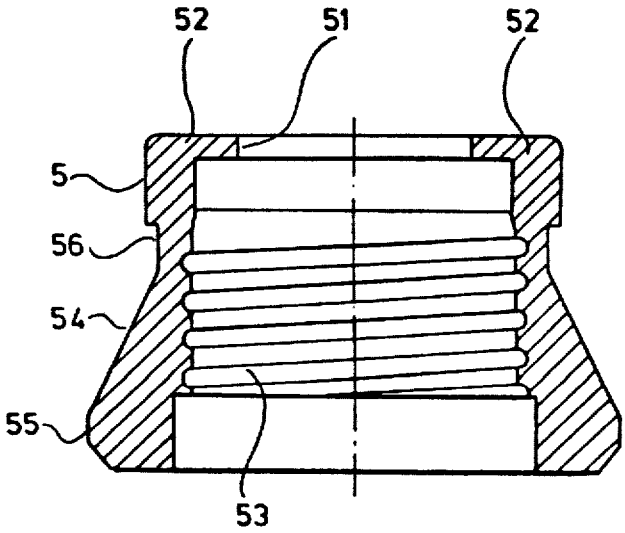
FIG. 7 is a sectional view of a screw cap for use in the embodiment according to FIG. 6.

FIGS. 6 and 7 illustrate another variant or embodiment of the invention. In this embodiment, the screw cap 5 is modified in such a way that it is enlarged (in diameter) in the direction of its lower edge. To this effect, the screw cap includes a conical enlargement or bulge starting at the level of groove 56 and terminating in a cylindrical knurled portion 55. The closure cap 6 slides with its lower opening along this conical enlargement 54 to become expanded thereby. In order to facilitate such expansion, the lower portion of closure cap 6 is provided with longitudinally (axially) extending breaking (rupturing) notches 57 as shown in FIGS. 6A and 6B. Preferably, four breaking formations spaced uniformly around the circumference are provided which are broken when the closure cap is operated. In addition, these breaking formations form a feature of originality, because the closure case cannot be removed without breaking them.

What we claim is:

1. In a teat feeding bottle comprising a container, a screw cap, a teat and a spike, said teat having a peripherally extending flange sealingly clamped by the flange of said screw cap against a neck portion of said container, said teat freely extending outwardly from said screw cap, said spike extending to the top of said teat and positioned substantially vertically and the pointed tip of said spike being spaced from a pierceable wall of said container, the improvement characterized by a longitudinal guiding portion for the pointed tip of said spike, said guiding portion being clamped between said pierceable wall and said flange of said screw cap; and a pushbutton-like enlargement of said spike positioned within the interior of said teat and provided on the opposite end from said pointed tip of said spike.

2. The teat feeding bottle according to claim 1, wherein said longitudinal guiding portion includes a central opening having an inner diameter slightly larger than the outer diameter of said spike, and said spike being provided with an axially extending groove.

3. The teat feeding bottle according to claim 2, wherein said spike includes in said portion adjacent to the pointed tip at least one radially cut annular notch.

4. The teat feeding bottle according to any one of claims 1, 2 and 3, wherein said longitudinal guiding portion includes a radially projecting annular flange disposed between said flange of said teat and an annular sealing ring, with a part extending from said radially projecting annular flange into the interior of said teat.

5. The teat feeding bottle according to claim 1, wherein said screw cap includes in its outer peripheral surface a radially cut annular groove into which a radially inwardly projecting annular collar of a closure cap engages.

6. The teat feeding bottle according to claim 5, wherein said screw cap is provided with a conical enlargement diverging from said radially cut annular groove towards said container.

7. The teat feeding bottle according to claim 6, wherein said closure cap is provided with longitudinal rupturing notches in the end portion facing said container.

8. The teat feeding bottle according to claim 4, wherein said part is cylindrically shaped.

9. The teat feeding bottle according to claim 4, wherein said part is conically shaped.

* * * * *